US006349749B1

(12) United States Patent
Quigley

(10) Patent No.: US 6,349,749 B1
(45) Date of Patent: Feb. 26, 2002

(54) WOVEN FABRIC

(75) Inventor: Scott Quigley, Townville, SC (US)

(73) Assignee: Geschmay Corp., Greenville, SC (US)

( * ) Notice: Subject to any disclaimer, the term of this patent is extended or adjusted under 35 U.S.C. 154(b) by 0 days.

(21) Appl. No.: 09/351,045

(22) Filed: Jul. 9, 1999

(51) Int. Cl.[7] ..... D03D 13/00; D03D 11/00

(52) U.S. Cl. ..... 139/383; 442/203; 442/207; 442/208; 162/904; 162/902; 139/383

(58) Field of Search ..... 442/203, 207, 442/208; 139/383; 162/902, 904; 428/57

(56) References Cited

U.S. PATENT DOCUMENTS 5,531,251 A * 7/1996 Rydin ..... 139/383
5,799,709 A 9/1998 Shipley
6,000,441 A * 12/1999 Lee et al. ..... 139/383

* cited by examiner

*Primary Examiner*—Terrel Morris
*Assistant Examiner*—Norca L. Torres

(74) *Attorney, Agent, or Firm*—Pitney, Hardin, Kipp & Szuch LLP

(57) ABSTRACT

A seamed endless papermaking fabric for use with papermaking machines. The fabric includes a plurality of CMD (cross machine direction) yarns intermeshing with a plurality MD (machine direction yarns) in a selected intermeshing pattern forming a contact surface and a support surface. The MD yarns, which are arranged to extend beyond the endmost of the CMD yarns at the opposed first and second ends of the fabric, form a plurality of spaced seaming loops across the fabric. These loops are adapted to interleaf and receive a pintle which forms the seam forming the fabric endless. A first pair of additional yarns are intermeshed in a first intermeshing pattern repeat with the MD yarns outwardly of the endmost of the CMD yarns at one of the opposed ends and a second pair of additional yarns are intermeshed in a second intermeshing pattern repeat with the MD yarns outwardly of the endmost of the CMD yarns at the other of the opposed ends. These first and second pairs of additional yarns separate the endmost CMD yarns from the pintle. The additional yarns are multi-filament yarns while the MD yarns are monofilament yarns.

10 Claims, 4 Drawing Sheets

12
26
24
18
W
10
22
20
16
1
2
3
4
5
6
7
8
9
10
11
12
13
14
15
16
17
18
19
20
21
22
23
24
L
F
P

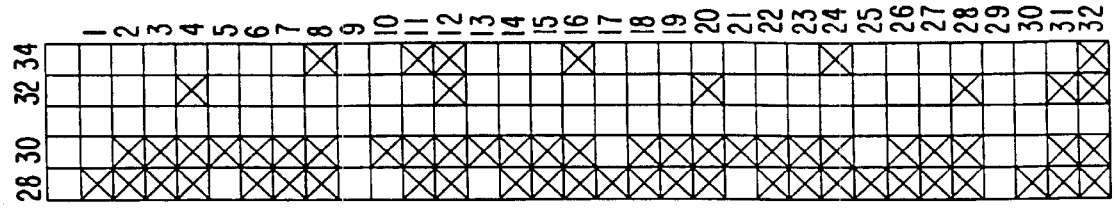
FIG. 6
FIG. 5
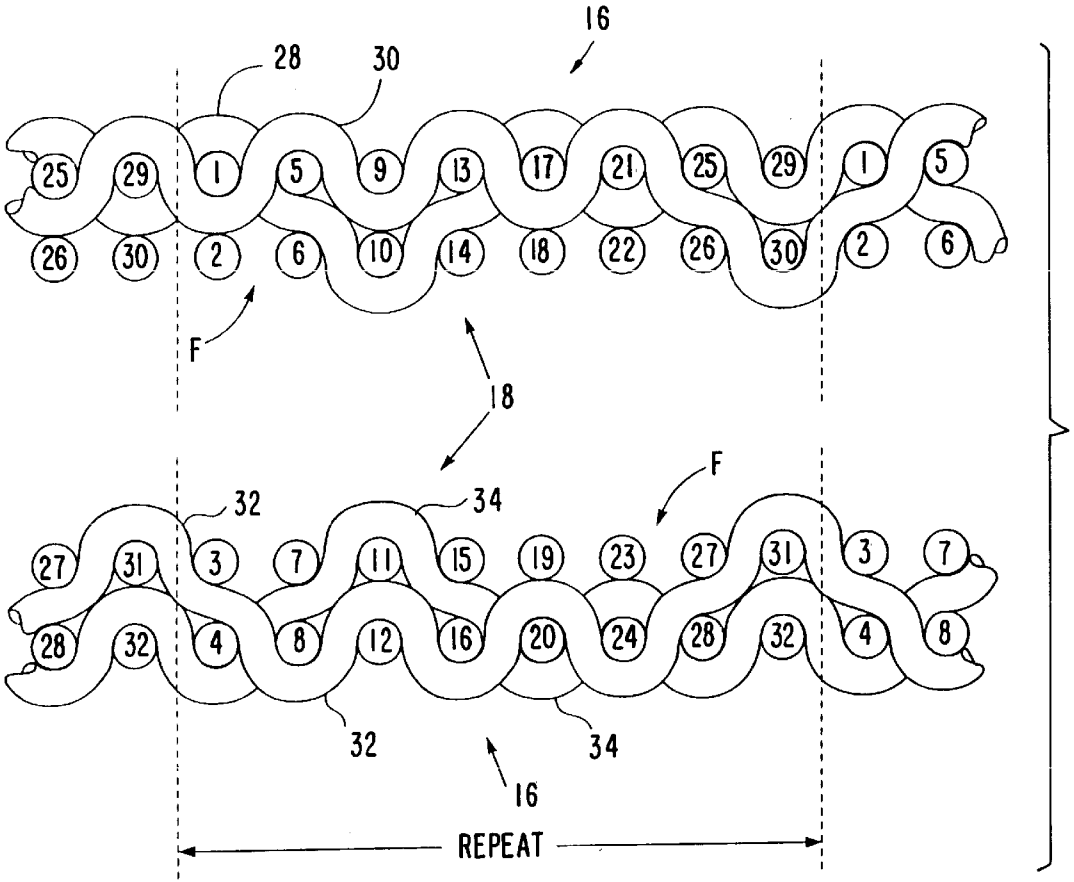

WOVEN FABRIC

BACKGROUND OF THE INVENTION

The present invention relates generally to a seam structure for a papermaking fabric woven endless.

Papermaking fabrics and particularly press fabrics have long used pintle seams as is illustrated in U.S. Pat. Nos. 4,737,241; 4,824,525; and 5,799,709. As shown, the pintle is normally of a larger diameter than the diameter of the transverse yarns. This requires that the loops be formed larger than the space required for a warp yarn in order to receive the pintle. Because of the pintle size, it is important that additional fiber be provided in the area of the seam to form additional cover to prevent undesirable markings on the paper. Another concern is that the endmost transverse yarns have a tendency to slip longitudinally into the area of the loop during use. This also causes unwanted markings on the paper.

Accordingly, it is an object of this invention, to provide a seam structure in which additional fibers are provided in the area of the seam.

Another object of the invention is a seam construction which utilizes additional multi-filament yarns outside of but adjacent the endmost transverse yarns of the fabric.

Another object of the invention is to provide a pintle seam structure which stabilizes the position of the endmost transverse yarns of the body portion of the fabric.

Another object of the invention is the provision of additional yarns adjacent the endmost transverse yarns of the fabric which interlace with and are exposed on both the support surface and the running surface.

Another object of the invention is the provision of a fabric structure capable of being needled to form a fiber cover over the area of the seam.

SUMMARY OF THE INVENTION

The instant invention is directed to a seamed endless papermaking fabric for use with papermaking machines which is formed with a machine contact surface and a paper support surface. The fabric includes a plurality of CMD (cross machine direction) yarns intermeshed with a plurality MD (machine direction yarns) in a selected intermeshing pattern. The MD yarns extend beyond the endmost of the CMD yarns at the opposed ends of the fabric forming a plurality of spaced seaming loops across each of these ends. The loops are adapted to be interleaved forming a channel which receives a pintle forming the seam forming the fabric endless. A first pair of additional yarns are intermeshed in a first intermeshing pattern repeat with the MD yarns outwardly of but adjacent the endmost CMD yarns at a first of the opposed ends of the fabric. A second pair of additional yarns are intermeshed in a second intermeshing pattern repeat with the MD yarns outwardly of and adjacent the CMD yarns at the second of the opposed ends of the fabric. These pairs of additional yarns are between the endmost CMD yarns and the pintle.

The first and second pairs of additional yarns and the MD yarns are interwoven in selected weave patterns while at least one of the first and second pairs of additional yarns interweaves with the MD yarns to appear primarily on the contact surface or they may be woven with the MD yarns to appear equally on the contact surface and the support surface.

The MD yarns are weft yarns and the additional yarns and the CMD yarns are warp yarns. The selected weave patterns repeat for the additional yarns on one of twenty-four and thirty-two picks. The CMD and MD yarns are preferably synthetic monofilament yarns while at least one of the first and second pairs of additional yarns are synthetic multi-filament yarns. Preferably all of the additional yarns are multi-filament synthetic yarns.

A seamed endless papermaking fabric for use on papermaking machines formed of a plurality of CMD (cross machine direction) yarns interwoven with a plurality of MD (machine direction) yarns in a selected weave pattern to form a contact surface and a support surface. The MD yarns extend beyond the endmost of the CMD yarns at opposed first and second ends of the fabric forming a plurality of spaced seaming loops across each end. These loops are adapted to interleaf and receive a pintle which forms the seam forming the fabric endless.

First and second pairs of additional yarns are interwoven in second and third selected weave patterns with the MD yarns outwardly of the endmost CMD yarns at the first and second ends. Each of the first and second yarns of each pair of additional yarns is interwoven with the MD yarns to appear on both the contact and support surfaces in each repeat of the second and third weave patterns. Each yarn of the first and second pair of additional yarns may appear equally on the contact surface and the support surface or each yarn of the first and second pairs of additional yarns may appear primarily on the support surface. Preferably, the additional yarns are synthetic multi-filament yarns, however, this is not necessary for both yarns of each pair. The second and third selected weave patterns of the additional yarns repeat on one of twenty-four and thirty-two picks.

DESCRIPTION OF THE DRAWINGS

The invention will be more readily understood from a reading of the following specification and by reference to the accompanying drawings forming a part thereof, wherein an example of the invention is shown and wherein:

FIG. 5 is an end view of a weave pattern repeat of the fabric shown in FIG. 4; and, FIG. 6 is a diagram of the weave pattern for the additional yarns of FIGS. 3 and 4.

DESCRIPTION OF A PREFERRED EMBODIMENT

Figure 4:
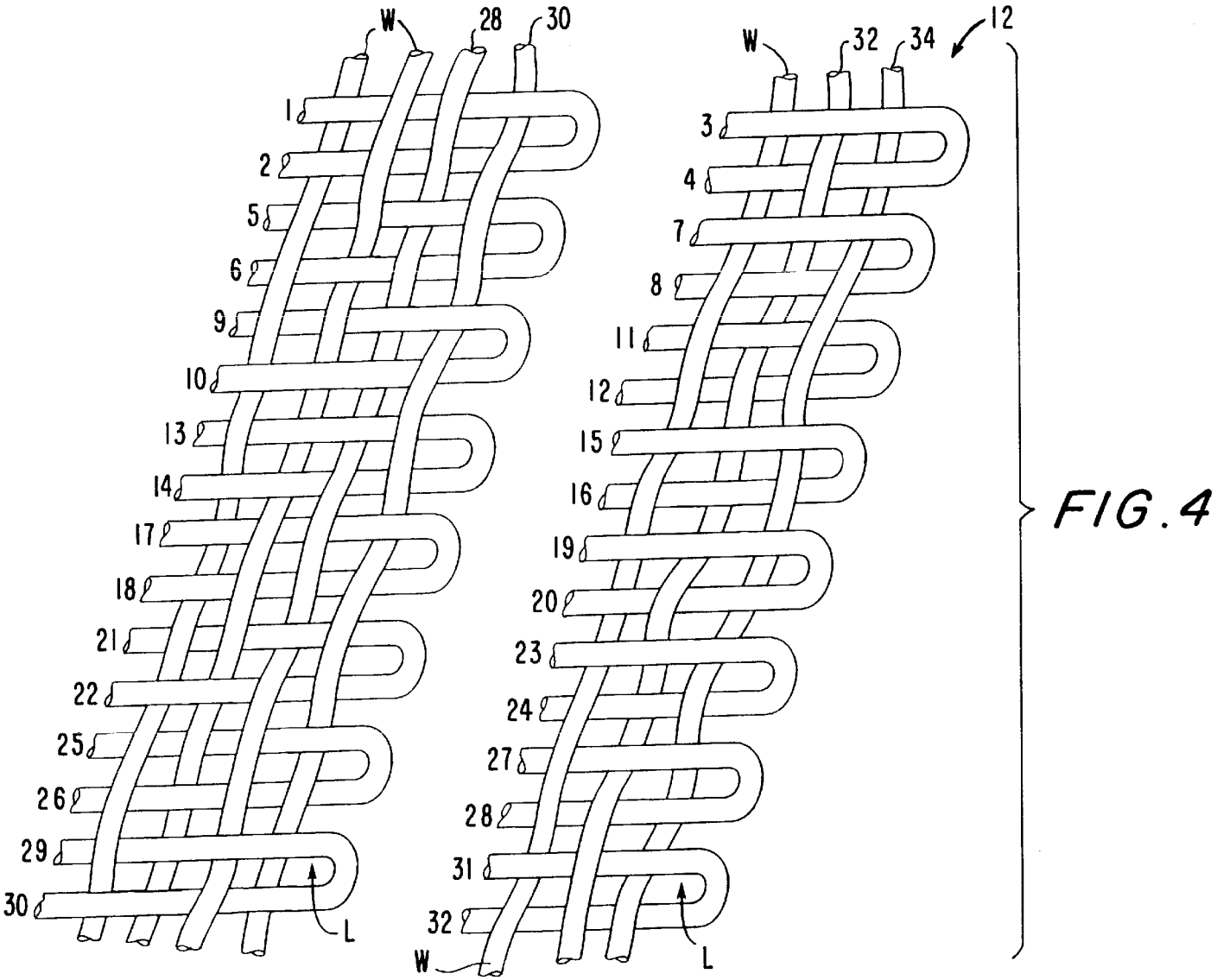
FIG. 4 is a sectional perspective view of a second arrangement of the seam structure of the invention.

Turning now to the drawings, FIGS. 1 and 4 are sectional perspective views of endless woven papermaking fabrics A and B, preferably for use in the press section of papermaking machines. Press fabrics A and B are woven with opposed longitudinal ends 10 and 12 positioned one above the other as shown. The body portion of each fabric is woven in any of a number of known weave patterns with warp yarns or CMD (cross machine direction) yarns W extending transversely of the longitudinal direction of press fabrics A, B and interweaving with weft, filling or MD (machine direction) yarns F to form a body portion consisting of an outer or support surface 16 and an inner or contact surface 18. Normally, both warp and weft yarns F, W are synthetic monofilament yarns.

Figures 1A, 1B:
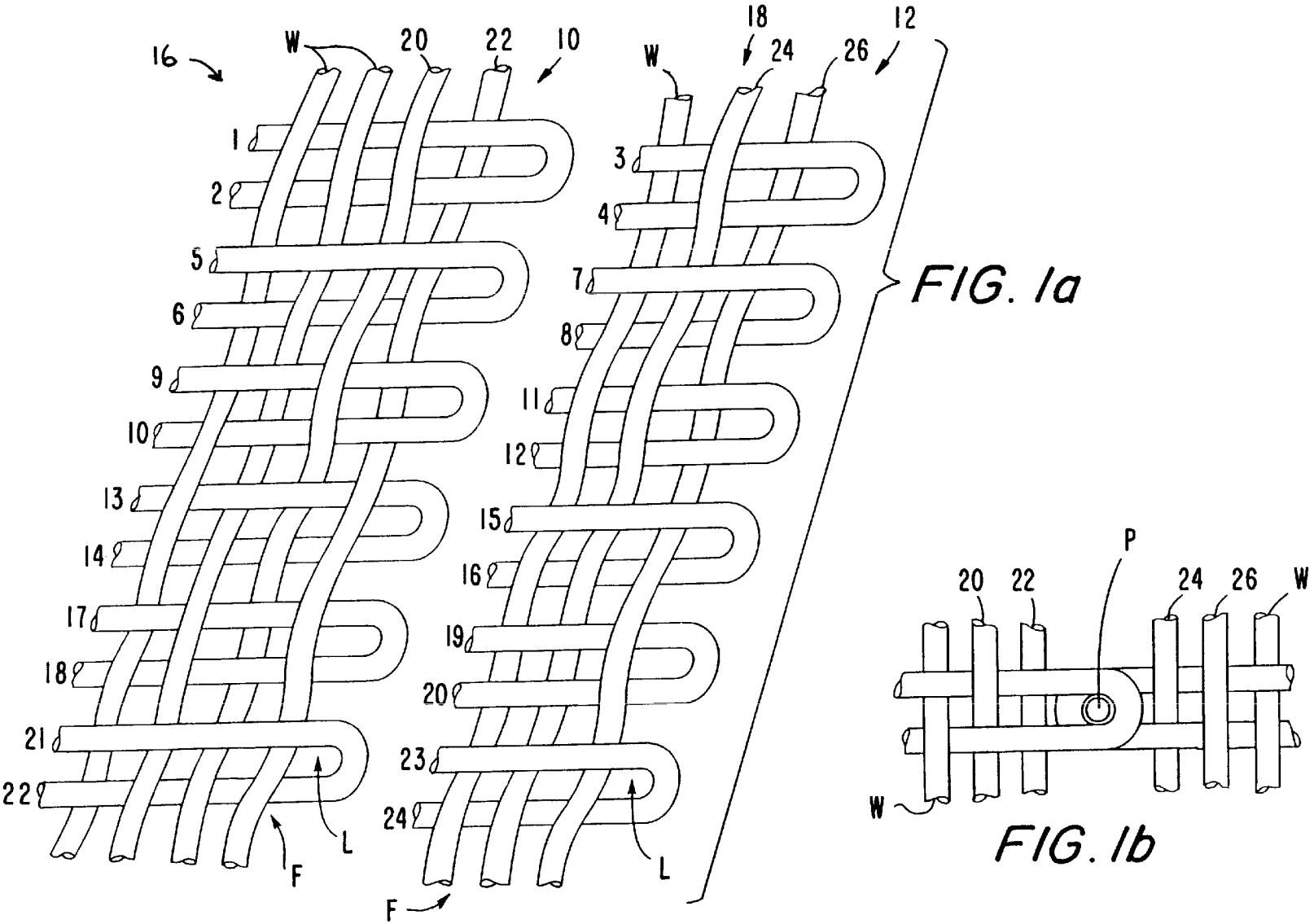
FIG. 1*a* is a sectional perspective view of a first arrangement of the seam structure of the invention.
FIG. 1*b* is a sectional side view of the fabric of FIG. 1 with loops L intermeshed and pintle P inserted.

The weft yarn F is woven with the warp yarns W to form loops L which extend outwardly from the outermost or endmost warp yarns W at the opposed ends of the press fabric A, B. Loops L of the opposing ends are adapted to intermesh or interleaf forming a cavity across the fabric. A pintle is inserted into the cavity, as shown in FIG. 1A, forming a pintle seam and forming fabrics A, B endless.

The structure so far described is well known and constitutes a usual manner of forming press fabrics endless. Seams formed in this manner have a tendency to form undesirable markings over the paper product due to the openess of the seamed area, the pintle size and the instability of the outermost or endmost warp yarns W adjacent to the seam.

Figure 3:
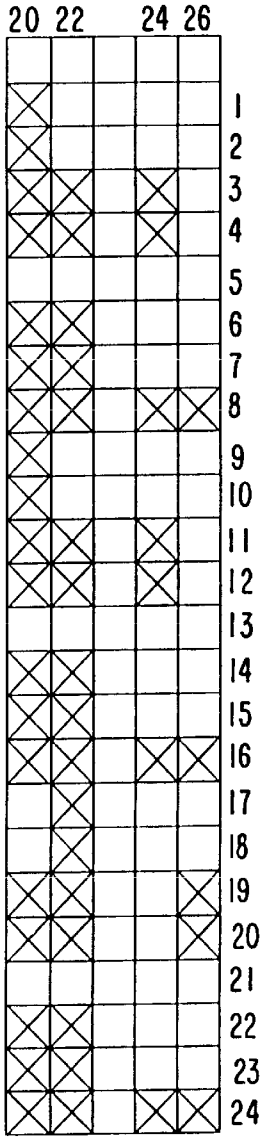
FIG. 3 is a diagram of the weave pattern for the additional yarns of FIGS. 1 and 2.
Figure 2:
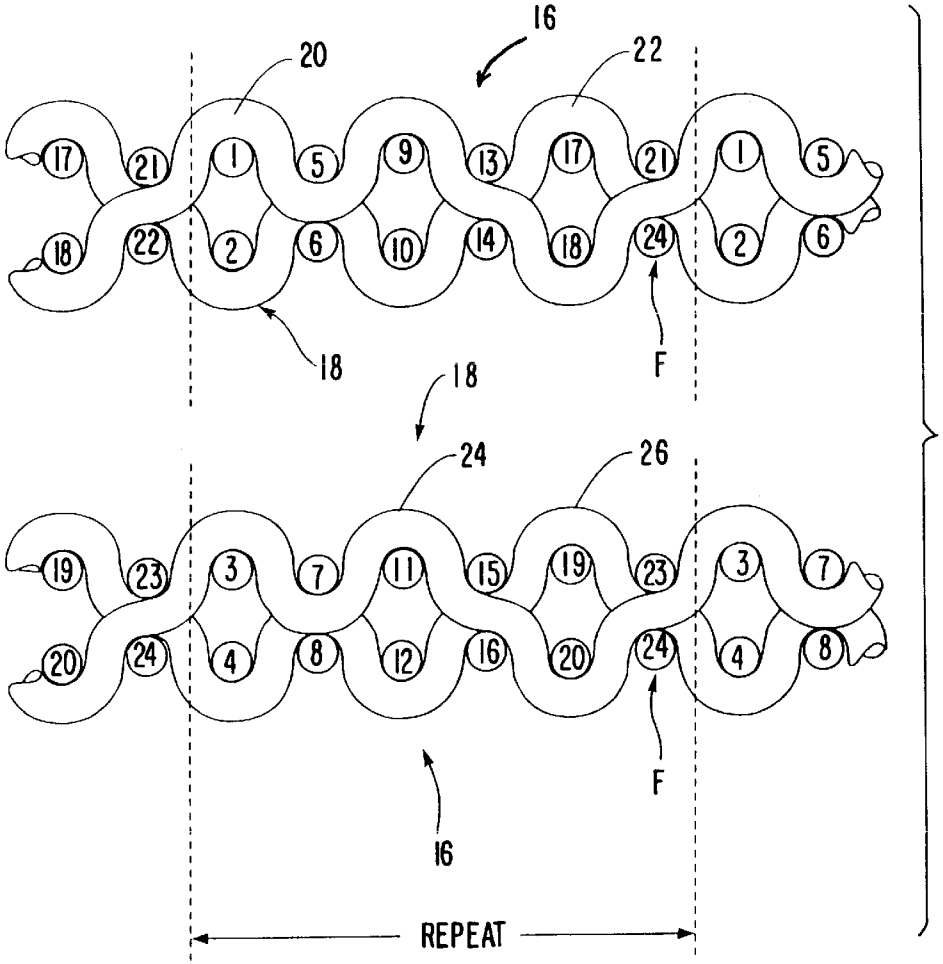
FIG. 2 is an end view of a weave pattern repeat of the fabric shown in FIG. 1.

A first aspect of the invention, as shown in FIGS. 1-3 provides structure which remove the above drawbacks.

In FIG. 1, between outermost warp yarns W and the outer extremity of loops L, additional warp yarns 20, 22, 24, 26 are interwoven with weft yarns F. These additional warp yarns are preferably each formed of multi-filament synthetic yarns which inherently are more flexible than the monofilament yarns W forming the body portion of fabric A.

Turning now to FIGS. 2 and 3, in the first arrangement of the invention, additional yarns 20, 22 are arranged along the upper end of fabric A as woven while additional yarns 24, 26 are arranged along the opposed and lower end of the fabric.

Additional yarns 20, 22, 24, 26 are interwoven in two weave patterns each having two yarns and twenty-four picks, as is shown in FIG. 3, with corresponding picks and warp yarns being identified in FIG. 1. As indicated in FIG. 2, additional yarns 20, 22 weave at one end of fabric A with yarn 20 weaving to be exposed at two crossovers of weft yarn F on support surface 16 and only one crossover on the contact surface. Additional yarn 22 weaves with weft F to form one crossover on support surface 16 and two crossovers on contact surface 18.

Additional yarns 24, 26 weave on the lower fabric end forming the opposite end of fabric A with yarn 24 forming two crossovers of the weft yarn on the contact surface and yarn 26 forming two crossovers of the weft yarn on the support surface.

Additional yarns 20, 22 and 24, 26, because of their increased flexibility tend to bind more securely with longitudinal yarns F securing the outermost yarns W against longitudinal slippage. When fabric A is seamed and formed continuous, yarns 20, 22, 24, and 26 may be needled to form additional cover over the seam. Each of these functions eliminate unwanted markings on the paper.

Turning now to FIGS. 4–6, a second arrangement of the invention is shown in which a pair of additional yarns 28, 30 weave with weft or MD yarns F adjacent the outermost yarn W on the upper end of fabric B while additional yarns 32, 34 weave adjacent the outermost CMD yarn W on the lower and of the opposite end of fabric B. Yarn 28 weaves with weft yarns F to form three crossovers on support surface 16 and one crossover on contact surface 18. Additional yarn 30 weaves with weft yarns F to form three crossovers on the support surface and one crossover on the contact surface. Additional yarns 32, 34 each weaves adjacent the outermost CMD yarn W adjacent the lower and second end of fabric B to form three crossovers on the support surface 16 and one crossover on the contact surface.

As in fabric A additional yarns 28, 30, 32, and 34 are preferably multi-filament synthetic yarns which form a more stable end structure and can be needled to form a cover over the connected seam.

As is well known, fabrics A and B are woven in folded form with MD or weft 15.1 yarn F weaving picks 1 and 2 into warp yarns W and additional yarns 20, 22 or 28, 30 to form the upper half of the fabric and then weaving picks 3 and 4 into warp yarns W and additional yarns 24, 26 or 32, 34 to form the lower half of the fabric as shown in FIGS. 1 and 4. The sequence continues with picks 5, 6; 9, 10; 13, 14; 17, 18; 21, 22 weaving with the upper layer and picks 7,8; 11, 12; 15, 16; 19, 20; 23, 24 weaving with the lower layer as shown in FIG. 1. The alternative arrangement shown in FIG. 4 is woven in similar with picks 1–32 forming a weave pattern repeat for each of the weave patterns. These weaving arrangements require substantially different weaving patterns for the weaving of the additional yarns with the first or upper end and those weaving with the second or lower end. FIGS. 3 and 6 shown clearly the weaving pattern differences per pattern repeat.

It is noted that the seam structure may be limited to two additional yarns interwoven with the MD yarns adjacent only one end of the fabric.

While a preferred embodiment of the invention has been described using specific terms, such description is for illustrative purposes only, and it is to be understood that changes and variations may be made without departing from the spirit or scope of the following claims.

What is claimed is:

1. A seamed endless papermaking fabric for use with papermaking machines having a machine contact surface and a paper support surface comprising;

a plurality of CMD (cross machine direction) yarns intermeshing with a plurality of MD (machine direction) yarns in a selected intermeshing pattern forming said contact surface and said support surface;

said MD yarns extending beyond endmost of said CMD yarns at opposed first and second ends of said fabric forming a plurality of spaced seaming loops across each of said opposed ends of said fabric, said loops being adapted to interleaf and receive a pintle forming said seam and forming said fabric endless;

a first pair of additional yarns intermeshing in a first intermeshing pattern repeat with said MD yarns, and between said contact surface and said support surface, outwardly of said endmost CMD yarns at said first of said opposed ends, one of said first pair of additional yarns appearing primarily on said contact surface, and the other of said first pair of additional yarns appearing primarily on said support surface;

a second pair of additional yarns intermeshing in a second intermeshing pattern repeat with said MD yarns, and between said contact surface and said support surface, outwardly of said endmost CMD yarns at said second of said opposed ends; wherein, said first and second pairs of additional yarns separate said endmost CMD yarns from said pintle.

2. The fabric of claim 1 wherein said intermeshed MD and CMD yarns are interwoven.

3. The fabric of claim 1 wherein said intermeshed first and second pairs of additional yarns and said MD yarns are interwoven in selected weave patterns.

4. The fabric of claim 1 wherein one of said second pair of additional yarns appears primarily on said contact surface, and the other of said second pair of additional yarns appears primarily on said support surface.

5. The fabric of claim 3 wherein each yarn of said additional yarns of at least one of said opposed ends is interwoven with said MD yarns to appear on said contact surface at least once during each repeat of said weave pattern.

6. The fabric of claim 3 wherein said MD yarns are weft yarns and said additional yarns are warp yarns.

7. The fabric of claim 3 wherein said selected weave pattern repeats on one of twenty-four and thirty-two picks.

8. The fabric of claim 1 wherein said CMD and MD yarns are synthetic monofilament yarns.

9. The fabric of claim 1 wherein at least one of said first and second pairs of additional yarns are synthetic multi-filament yarns.

10. The fabric of claim 1 wherein said additional yarns are multi-filament synthetic yarns.

* * * * *